US011647872B2

(12) United States Patent
McNulty et al.

(10) Patent No.: US 11,647,872 B2
(45) Date of Patent: May 16, 2023

(54) DOUBLE INLET VALVE FOR ENHANCED PUMP EFFICIENCY

(71) Applicant: GOJO Industries, Inc., Akron, OH (US)

(72) Inventors: John J. McNulty, Broadview Heights, OH (US); Donald R. Harris, Mogadore, OH (US); Aaron D. Marshall, Uniontown, OH (US); Daniel M. Willis, Clinton, OH (US); Nick E. Ciavarella, Seven Hills, OH (US)

(73) Assignee: GOJO Industries, Inc., Akron, OH (US)

( * ) Notice: Subject to any disclaimer, the term of this patent is extended or adjusted under 35 U.S.C. 154(b) by 0 days.

(21) Appl. No.: 17/668,781

(22) Filed: Feb. 10, 2022

(65) Prior Publication Data

US 2022/0160184 A1 May 26, 2022

Related U.S. Application Data

(63) Continuation of application No. 16/424,832, filed on May 29, 2019, now Pat. No. 11,246,457, which is a (Continued)

(51) Int. Cl.
*A47K 5/12* (2006.01)
*B67D 3/00* (2006.01)

(52) U.S. Cl.
CPC ..... *A47K 5/1211* (2013.01); *B67D 3/0012* (2013.01)

(58) Field of Classification Search
CPC . B05B 11/3071; A47K 5/1207; A47K 5/1208; A47K 5/1209; A47K 5/1211;
(Continued)

(56) References Cited

U.S. PATENT DOCUMENTS

| | | | | |
|---|---|---|---|---|
| 1,380,415 | A | 6/1921 | Putnam | |
| 3,952,918 | A | 4/1976 | Poitras et al. | |
| 5,004,123 | A | 4/1991 | Stoody | |
| 5,390,814 | A | 2/1995 | Christine et al. | |
| 5,469,990 | A | 11/1995 | Wodeslavsky | |
| 8,733,600 | B2 * | 5/2014 | Pritchard | B65D 75/5877 222/541.9 |

(Continued)

FOREIGN PATENT DOCUMENTS

| | | | |
|---|---|---|---|
| JP | 06009977 | A | 1/1994 |
| WO | 2011144861 | A1 | 11/2011 |

OTHER PUBLICATIONS

International Search Report and Written Opinion from PCT/US2018/058448 dated Feb. 22, 2019 (14 pages).

*Primary Examiner* — Vishal Pancholi
*Assistant Examiner* — Robert K Nichols, II
(74) *Attorney, Agent, or Firm* — Calfee, Halter & Griswold LLP

(57) ABSTRACT

An dispenser includes a housing, a container disposed in the housing for holding a liquid, a nozzle, and a pump. The pump is disposed between the container and the nozzle. The pump includes a pump inlet, a pump outlet, a pump chamber, a first check valve, and a second check valve. The pump inlet is in fluid communication with the container and the pump chamber, and the pump outlet is in fluid communication with the pump chamber and the nozzle. The pump chamber is movable between an expanded position and a compressed position. The first check valve is disposed between the container and the pump, and the first check valve has a first cracking pressure. The second check valve is disposed between the first check valve and the pump, and the second check valve has a second cracking pressure. The first cracking pressure of the first check valve is greater than the second cracking pressure of the second check valve.

20 Claims, 6 Drawing Sheets

Related U.S. Application Data continuation-in-part of application No. 16/175,957, filed on Oct. 31, 2018, now Pat. No. 11,089,913.

(60) Provisional application No. 62/581,820, filed on Nov. 6, 2017.

(58) Field of Classification Search
CPC ..... A47K 5/1217; A47K 5/12; F04B 19/22; F04B 43/00; F04B 43/02; F04B 53/1002; B67D 1/06; B67D 3/0029; F16K 15/00; F16K 15/186; F16K 15/188; B65D 47/2068; B65D 47/2075; B65D 51/226; B65D 51/2835; B65D 77/067; B67B 7/24
See application file for complete search history.

(56) References Cited

U.S. PATENT DOCUMENTS

| | | | | |
|---|---|---|---|---|
| 2002/0125271 | A1 | 9/2002 | Zeitlin | |
| 2006/0249536 | A1 | 11/2006 | Hartman et al. | |
| 2008/0135578 | A1 | 6/2008 | Ophardt | |
| 2010/0133273 | A1* | 6/2010 | Thurman ..... | B65D 47/0838 220/378 |
| 2013/0206794 | A1 | 8/2013 | McNulty et al. | |
| 2014/0224356 | A1* | 8/2014 | Hatton ..... | B65D 47/2031 137/522 |
| 2014/0252042 | A1 | 9/2014 | Cittadino | |
| 2015/0028065 | A1* | 1/2015 | Arch ..... | B65D 47/2037 222/567 |
| 2017/0156550 | A1 | 6/2017 | Ciavarella et al. | |

* cited by examiner

DOUBLE INLET VALVE FOR ENHANCED PUMP EFFICIENCY

RELATED APPLICATIONS

This application is a continuation of U.S. Non-Provisional application Ser. No. 16/424,832, filed on May 29, 2019, which is a continuation-in-part of U.S. Non-Provisional patent application Ser. No. 16/175,957, filed on Oct. 31, 2018, now U.S. Pat. No. 11,089,913, which claims priority to and the benefits of U.S. Provisional Application Ser. No. 62/581,820, filed on Nov. 6, 2017, all of which are incorporated herein by reference in their entirety.

BACKGROUND

Dispenser systems, such as liquid soap and sanitizer dispensers, provide a user with a predetermined amount of liquid upon actuation of the dispenser. In addition, it is sometimes desirable to dispense the liquid in the form of foam by, for example, injecting air into the liquid to create a foamy mixture of liquid and air bubbles. Dispenser systems often use a pump to pump liquid from a container and into the hand of a user.

SUMMARY

An exemplary dispenser includes a housing, a container disposed in the housing for holding a liquid, a nozzle, and a pump. The pump is disposed between the container and the nozzle. The pump includes a pump inlet, a pump outlet, a pump chamber, a first check valve, and a second check valve. The pump inlet is in fluid communication with the container and the pump chamber, and the pump outlet is in fluid communication with the pump chamber and the nozzle. The pump chamber is movable between an expanded position and a compressed position. The first check valve is disposed between the container and the pump, and the first check valve has a first cracking pressure. The second check valve is disposed between the first check valve and the pump, and the second check valve has a second cracking pressure. The first cracking pressure is greater than the second cracking pressure.

Another exemplary dispenser includes a housing, a container disposed in the housing for holding a liquid, a nozzle, and a pump. The pump is disposed between the container and the nozzle. The pump includes a pump inlet, a pump outlet, a pump chamber, a first check valve, and a second check valve. The pump inlet is in fluid communication with the container and the pump chamber, and the pump outlet is in fluid communication with the pump chamber and the nozzle. The pump chamber is movable between an expanded position and a compressed position. The first check valve is disposed between the container and the pump, and the second check valve is disposed between the first check valve and the pump. Movement of the pump chamber from the compressed position to the expanded position causes the first check valve to move to an open position such that a portion of the liquid moves from the container past the first check valve and causes the second check valve to open such that a portion of the liquid moves from the container past the second check valve and into the pump chamber. Movement of the pump chamber from the expanded position to the compressed position causes the first check valve to maintain a closed position such that liquid is prevented from moving from the container and into the pump chamber. The movement of the pump chamber from the expanded position to the compressed position also causes the second check valve to maintain a closed position such air cannot move into and be compressed in a space between the container and the second check valve.

An exemplary refill unit includes a container that has a neck. A closure is connected to the neck. The refill unit includes a liquid outlet path and a first check valve is located in the liquid outlet path. The first check valve has a cracking pressure of greater than 0.5 pounds per square inch. The refill unit includes a seal located in the passage downstream of the first check valve.

An exemplary dispensing system includes a housing and a container for holding a liquid. A liquid outlet is located on the bottom of the container. A sealing member seals the liquid outlet, allowing the container to be lowered into and removed from a dispenser without the liquid leaking out of the container. A first check valve is in fluid communication with the liquid outlet. The first check valve having a cracking pressure of greater than 0.5 pounds per square inch. A second check valve is in fluid communication with the liquid outlet. The second check valve has a cracking pressure that is less than the cracking pressure of the first check valve. A liquid pump chamber is located downstream of the first valve and the second check valve. A liquid outlet valve is located downstream of the liquid pump chamber. A mixing chamber is located downstream of the liquid outlet valve. Liquid flows into the liquid chamber and air from an air source flows into the mixing chamber and mixes with the liquid. An outlet nozzle is located downstream of the mixing chamber.

An exemplary dispenser for dispensing soap, sanitizer or lotion includes a housing, a container disposed in the housing holding a soap, a sanitizer or a lotion, and a pump disposed between the container and the nozzle. The pump includes a pump inlet in fluid communication with the container. A pump chamber is in fluid communication with the pump inlet and the pump outlet. The pump chamber is movable between an expanded position and a compressed position. A first check valve is disposed between the container and the pump. The first check valve has a cracking pressure of greater than about 0.5 psi. A second check valve is disposed between the first check valve and the pump. The second check valve having a cracking pressure that is less than about 0.5 psi.

DETAILED DESCRIPTION

The Detailed Description describes exemplary embodiments of the invention and is not intended to limit the scope of the claims in any way. Indeed, the invention is broader than and unlimited by the exemplary embodiments, and the terms used in the claims have their full ordinary meaning. Features and components of one exemplary embodiment may be incorporated into the other exemplary embodiments. Inventions within the scope of this application may include additional features, or may have less features, than those shown in the exemplary embodiments.

Figure 1:
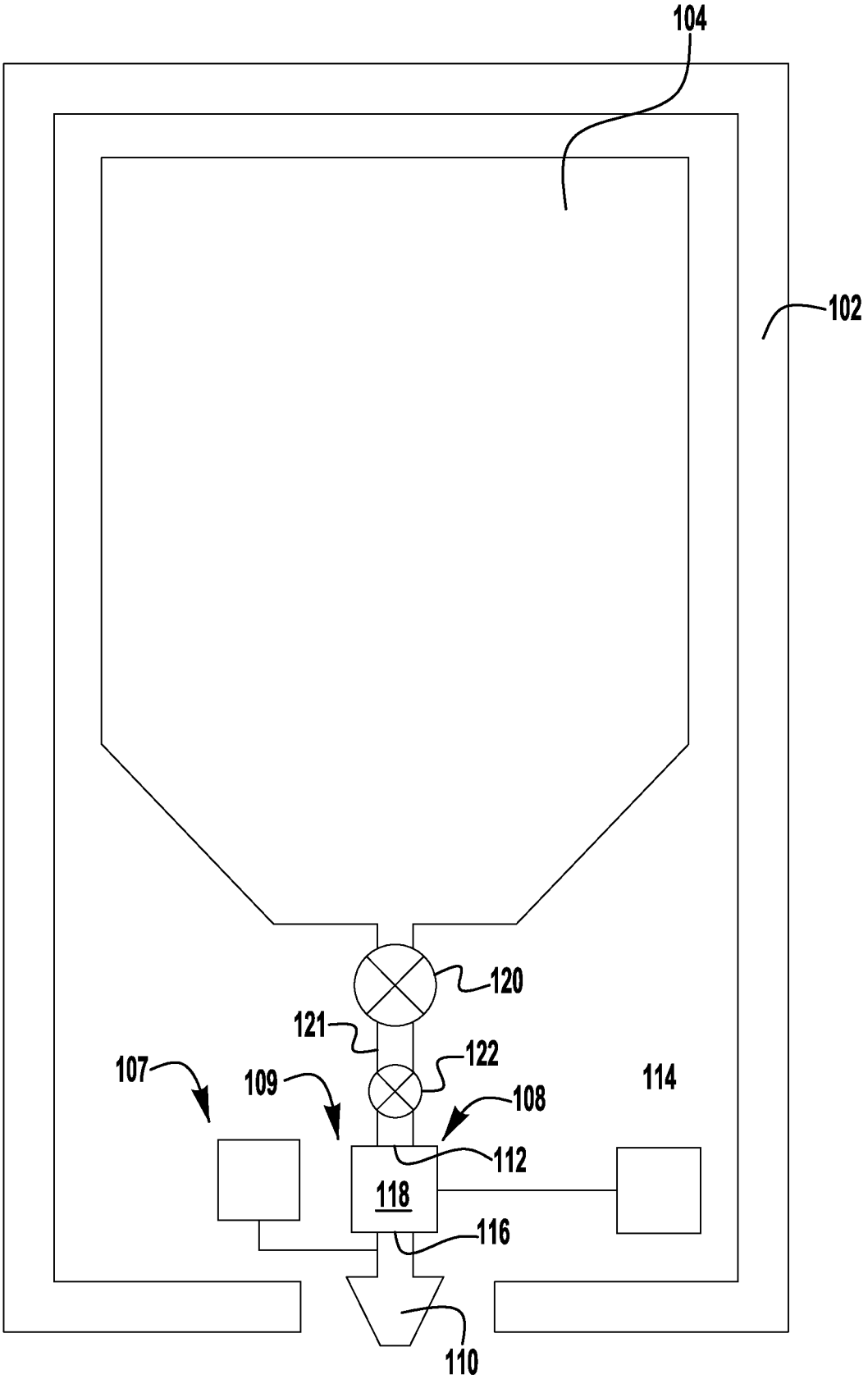
FIG. 1 is a cross-sectional/schematic view of an exemplary embodiment of a dispenser.

FIG. 1 illustrates an exemplary dispenser 100 having a housing 102, a container 104 for holding a liquid, a pump 108, a first check valve 120, a second check valve 122, and a dispenser outlet 110. The first check valve 120, a second check valve 122 are located upstream of the liquid inlet of the pump 108. The pump 108 is configured to pump the liquid from the container 104 through the outlet 110. In some embodiments, the liquid can be, for example, soap, a concentrated soap, a sanitizer, a lotion, a moisturizer or the like. The pump 108 may be, for example, a displacement pump, such as, for example, a piston pump, a diaphragm pump, a rotary pump, or the like. In certain embodiments, the pump 108 may be a sequentially activated multi-diaphragm foam pump. Exemplary embodiments of sequentially activated multi-diaphragm pumps are shown and disclosed in: U.S. Non-Provisional application Ser. No. 15/429,389 filed on Feb. 10, 2017 and titled HIGH QUALITY NON-AEROSOL HAND SANITIZING FOAM; U.S. Non-Provisional application Ser. No. 15/369,007 filed on Dec. 5, 2016 and titled SEQUENTIALLY ACTIVATED MULTI-DIAPHRAGM FOAM PUMPS, REFILL UNITS AND DISPENSER SYSTEMS; U.S. Non-Provisional patent application Ser. No. 15/355,112 filed on Nov. 18, 2016 and titled SEQUENTIALLY ACTIVATED MULTI-DIAPHRAGM FOAM PUMPS, REFILL UNITS AND DISPENSER SYSTEMS; U.S. Non-Provisional application Ser. No. 15/350,190 filed on Nov. 14, 2016 and titled IMPROVED FOAMING CARTRIDGE; U.S. Non-Provisional application Ser. Ser. No. 15/356,795 filed on Nov. 21, 2016 and titled FOAM DISPENSING SYSTEMS, PUMPS AND REFILL UNITS HAVING HIGH AIR TO LIQUID RATIOS; and U.S. Non-Provisional application Ser. No. 15/480,711 filed on Apr. 6, 2017 and titled FOAM DISPENSING SYSTEMS, PUMPS AND REFILL UNITS HAVING HIGH AIR TO LIQUID RATIOS; each of which are incorporated herein in their entirety.

In some exemplary embodiments, the pump 108 may be a foam pump that includes a liquid pump 109 and an air pump 107. In some embodiments, the air pump and liquid pump portions are integrated into a single pump. In some embodiments, the pump 108 is a split pump and the liquid pump portion is connected to the container as a single unit that may be replaced. In an exemplary embodiment, the liquid pump portion separates from the air pump portion, which remains with the housing. Accordingly, as used herein, pump 108 may be a liquid pump or a foam pump and may have many different configurations and should not be limited to the illustrated examples.

In some exemplary embodiments, the dispenser 100 may include a foam cartridge (not shown). In certain of these exemplary embodiments, a liquid pump 109 pumps liquid from the container into a mixing chamber (not shown) and the air pump 107 pumps air into the mixing chamber (not shown) to mix with the liquid, and the liquid-air mixture travels through the foam cartridge to create a rich foam. Exemplary embodiments of foam pumps are shown and described in, U.S. Pat. No. 7,303,099 titled Stepped Pump Foam Dispenser; U.S. Pat. No. 8,002,150 titled Split Engagement Flange for Soap Piston; U.S. Pat. No. 8,091,739 titled Engagement Flange for Fluid Dispenser Pump Piston; U.S. Pat. No. 8,113,388 titled Engagement Flange for Removable Dispenser Cartridge; U.S. Pat. No. 8,272,539, Angled Slot Foam Dispenser; U.S. Pat. No. 8,272,540 titled Split Engagement Flange for Soap Dispenser Pump Piston; U.S. Pat. No. 8,464,912 titled Split Engagement Flange for Soap Dispenser Pump Piston; U.S. Pat. No. 8,360,286 titled Draw Back Push Pump; U.S. Provisional Pat. Ser. No. 62/293,931 titled High Quality Non-Aerosol Hand Sanitizing Foam; U.S. Provisional Pat. Application Ser. No. 62/257,008 titled Sequentially Activated Multi-Diaphragm Foam Pumps, Refill Units and Dispenser Systems; U.S. Pat. No. 8,172,555 titled Diaphragm Foam Pump; U.S. 2008/0,277,421 titled Gear Pump and Foam Dispenser, all of which are incorporated herein by reference in their entirety. These exemplary foam pumps may be converted to liquid pumps by removing the air pump components. Exemplary embodiments of foam cartridges 134 are shown and described in U.S. Publication No. 2014/0367419 titled Foam Cartridges, Pump, Refill Units and Foam Dispensers Utilizing The Same, which is incorporated herein by reference in its entirety.

In various embodiments, the dispenser 100 is a "touch free" dispenser and includes an actuator 114 that activates the pump 108 to pump liquid from the container 104 and out of the nozzle 110 of the dispenser 100. Exemplary touch-fee dispensers are shown and described in U.S. Pat. No. 7,837,066 titled Electronically Keyed Dispensing System And Related Methods Utilizing Near Field Response; U.S. Pat. No. 9,172,266 title Power Systems For Touch Free Dispensers and Refill Units Containing a Power Source; U.S. Pat. No. 7,909,209 titled Apparatus for Hands-Free Dispensing of a Measured Quantity of Material; U.S. Pat. No. 7,611,030 titled Apparatus for Hans-Free Dispensing of a Measured Quantity of Material; U.S. Pat. No. 7,621,426 titled Electronically Keyed Dispensing Systems and Related Methods Utilizing Near Field Response; and U.S. Pat. No. 8,960,498 titled Touch-Free Dispenser with Single Cell Operation and Battery Banking; all which are incorporated herein by reference. In embodiments that include a touch-free feature, the dispenser 100 may include a power source (not shown), a sensor (not shown), a controller (not shown), and a motor (not shown). The power source is in electrical communication with and provides power to the sensor, controller, and motor. The power source may be an internal power source, such as, for example, one or more batteries or an external power source, such as, for example, solar cells, or a conventional 120 VAC power supply. In some embodiments, a multiple power supplies are included, such as, for example, batteries and solar cells.

In various embodiments, the dispenser is a manual dispenser. In such embodiments, the actuator 114 may require manual activation, such as, for example, a user engages a push bar, a user engages a foot pedal, a pushbutton, or the like. In some embodiments that require manual activation, a push bar (not shown) is mechanically coupled to the actuator 114 and, when a user engages the push bar, the actuator 114 causes liquid from the container 104 to be pumped through the nozzle 110 of the dispenser 100.

Still referring to FIG. 1, an exemplary embodiment of a pump 108 includes a pump inlet 112, a pump outlet 116, and a pump chamber 118. The pump inlet 112 is in fluid communication with the container 104 such that the pump inlet can receive liquid from the container 104. The pump chamber 118 is in fluid communication with the pump inlet 112 such that the pump chamber can receive liquid from the container 104 through the pump inlet 122. The pump outlet 116 is in fluid communication with the pump chamber 118 and with the nozzle 110 such that the pump 108 can pump liquid from the pump chamber through the pump outlet 116 and the nozzle 110. In certain embodiments, the pump 108 is a positive displacement pump such that movement of the pump chamber 118 between an expanded position and a compressed position causes the pump to pump liquid through the nozzle 110 of the dispenser 100 and to move liquid from the container and into the pump chamber. In certain embodiments, the pump chamber 118 has a small volume. In certain embodiments, the volume of pump chamber 118 is between about 0.2 cc and about 0.5 cc when the pump chamber is in the expanded position.

The dispenser 100 includes a first check valve 120 and a second check valve 122. Both the first check valve 120 and the second check valve 122 are located in-line between the container 104 and the pump 108. The first check valve 120 is a normally closed valve and it prevents liquid from entering the pump chamber 118 when the first check valve is in a closed position. The first check valve 120 also prevents fluid from flowing from the pump 108 back up into the container 104. First check valve 120 moves to an open position when a sufficient cracking pressure is present between the pump 108 and the first check valve 120. Movement of the first check valve 120 from the closed position to an open position allows liquid to flow from the container 104, into the area 121 between the first check valve 120 and the second check valve 122 and past first check valve 120 into pump chamber 118. Movement of the first check valve 120 from the open position back to the closed position prevents the liquid in the container 104 from entering the pump chamber 118. In various embodiments, the first check valve 120 is a high flow valve that is configured to prevent static drip of liquid from the container 104 through the pump 108 when the first check valve 120 is in the closed position. The first check valve 120 may be, for example, a ball and spring valve, a mushroom valve, a flapper valve, and the like. In some embodiments, first check valve 120 has a cracking pressure of at least about 0.5 psi. In some embodiments, first check valve 120 is a slow reacting check valve and is configured to hold back head pressure from the container.

The second check valve 122 is disposed between the first check valve 120 and the pump 108. In certain embodiments, the second check valve 122 is disposed adjacent to the pump chamber 118 of the pump 108. The second check valve 122 is configured to limit the volume of the pump chamber. In some embodiments, the limited volume prevents air from being compressed in the area between the container 104 and the pump 108 which tends to prevent or inhibit upstream vacuum pressure, which may occur during, for example, priming and use of the dispenser 100. The second check valve 122 is moved to an open position by vacuum pressure created in the pump chamber 118. Movement of the second check valve 122 from the closed position to the open position allows liquid to flow from the container 104, past the first check valve 120 and into the pump chamber 118, and movement of the second check valve 122 from the open position to the closed position prevents air or liquid from flowing from the pump chamber 118 back towards the container 104.

Without second check valve 122, when a small pump chamber 118 is used, compression and expansion of the pump chamber 118 may cause compression/decompression of air between the pump chamber 118 and first check valve 120 without opening the first check valve 120 thereby resulting in a failure to prime pump chamber 118. In certain embodiments, the second check valve 122 is a high flow, fast acting valve. In some embodiments, second check valve 122 has minimal cracking pressure. In some embodiments, the cracking pressure is between about 0 and about 2 psi. Second check valve 122 is fast acting and in certain embodiments closes in less than about 0.1 second. The second check valve 122 may be, for example, an umbrella valve, a duckbill valve, a flapper valve, and the like. In certain embodiments, the second check valve 122 is a normally-open valve. In alternative embodiments, the second check valve 122 is a normally-closed valve. The first check valve 120 has a greater cracking pressure than the second check valve 122.

To operate the dispenser 100, a user activates the pump 108 using the actuator 114, which causes liquid to move from the pump chamber 118, through the nozzle 110, and into a hand of the user. In certain embodiments, the pump 108 includes a liquid pump portion 109 (that includes the liquid pump chamber 118) and an air pump portion 107. In these embodiments, the liquid pump portion 109 pumps liquid from the container 104, the air pump portion 107 pumps air, and the liquid and air mix to form a foamy mixture. In alternative embodiments, the dispenser 100 is a liquid dispenser and pump 108 that only includes a liquid pump portion 109.

The activation of the pump 108 causes the pump chamber 118 to move from an expanded position to a compressed position. When the pump chamber 118 compresses, check valve 122 closes preventing fluid from flowing into the space between check valve 120 and check valve 122. This movement from the expanded position to the compressed position forces liquid in the pump chamber 118 to move through the pump outlet 116 and out a nozzle 110 of the dispenser. During this movement of the pump chamber 118 from the expanded to the compressed position, the second check valve 122 closes very fast and maintains a closed position preventing air in the passage between the container 104 and the pump chamber 118 from compressing/uncompressing thus preventing the pump 108 from operating properly. After the liquid is dispensed through the nozzle 110, the pump chamber 118 moves back to an expanded position, which creates a negative pressure in the pump chamber 118. This negative pressure creates a vacuum pressure that causes the first check valve 120 and the second check valve 122 to move from a closed position to an open position. The movement of the first check valve 120 and second check valve 120 to the open position allows liquid from the container 104 to flow past the first and second check valves 120, 122, through the pump inlet 112 and into the pump chamber 118. The second check valve 122 must be fast acting and is advantageous because without it, air being compressed between the container 104 and the pump 108 may prevent the pump chamber 118 from being sufficiently filled with liquid from the container 104 during operation of pump 108, and in particularly during priming of the pump 108, which would cause the pump 108 to be less efficient or not work at all.

Figure 2:
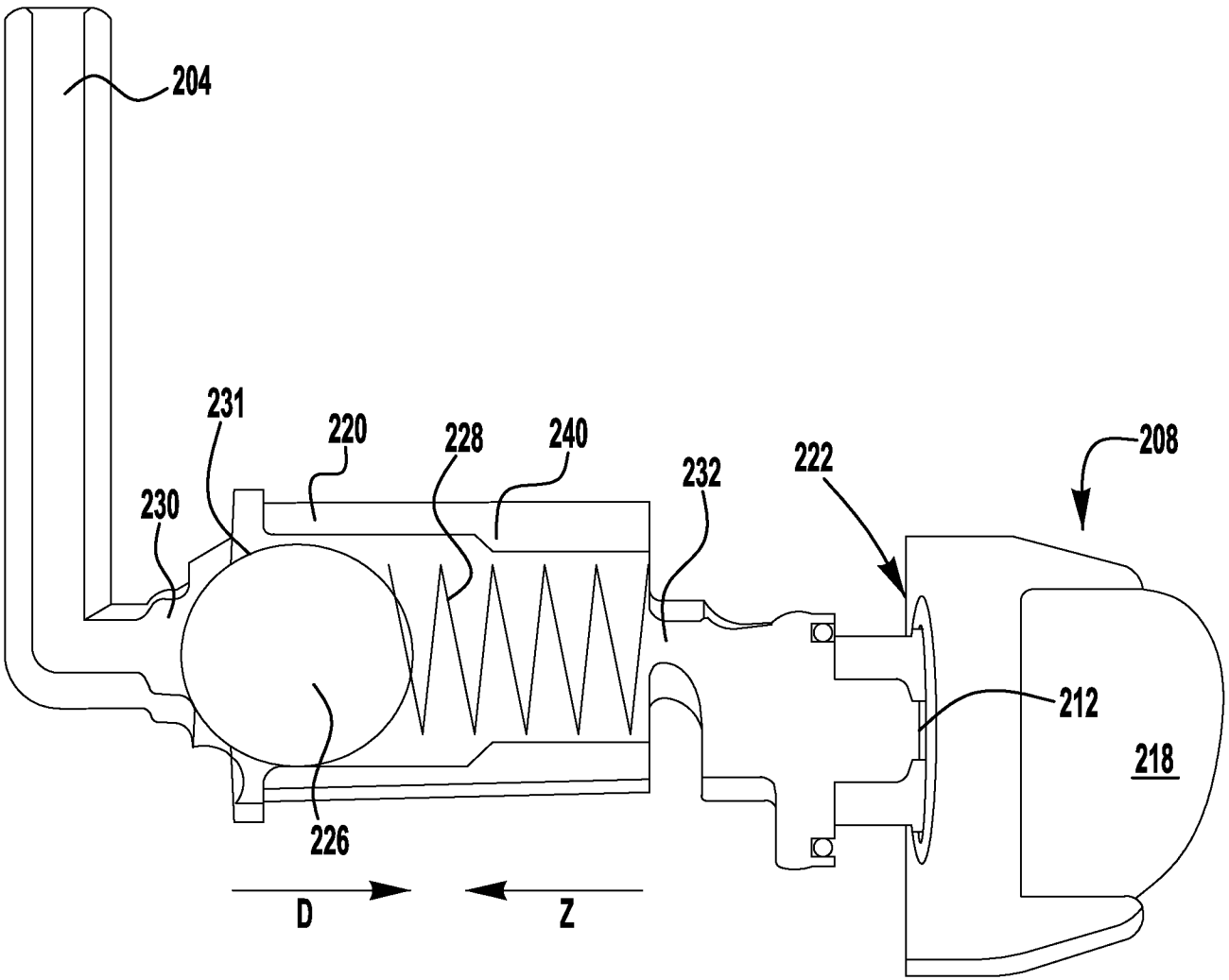
FIG. 2 is a partial cross-sectional view of another exemplary embodiment of a portion of a dispenser.

Referring to FIG. 2, another exemplary embodiment of a double acting valve portion of a dispenser 200 includes an inlet 204 that is connected to a container (not shown), a pump 208, a first check valve 220, and a second check valve 222. The pump 208 includes a pump inlet 212, a pump outlet (not shown), and a pump chamber 218. The pump chamber 218 is movable between an expanded position and a compressed position. In certain embodiments, the pump chamber 218 is a small pump chamber. In certain embodiments, pump chamber 218 has a volume between about 0.2 cc and about 0.5 cc when the pump chamber is in the expanded position.

The first check valve 220 and the second check valve 222 are disposed between the inlet 204 from the container and the pump 208. The first check valve 220 includes an inlet 230, an outlet 232, a ball 226, and a biasing member 228 (e.g., a spring). The first check valve 220 is movable between an open position and a closed position. The first check 220 valve is in the closed position when the ball 226 engages the seal 231 of inlet 230, and the first check valve 220 is in the open position when the ball 226 is moved away from the seal 231 in the direction D allowing fluid flow. In certain embodiments, the first check valve 220 is a normally closed valve, in which the biasing member 228 exerts a force on the ball 226 in the direction Z that causes the first check valve 220 to maintain the closed position. When the first check valve 220 is in the closed position, liquid from the inlet 204 is prevented from moving through the inlet 230 and the outlet 232 of the first check valve 220. In some embodiments, first check valve 220 has a cracking pressure that is greater than the head pressure in the container. The first check valve 220 moves to an open position when sufficient vacuum pressure is developed in the system downstream of first check valve 220. Movement of the ball in the direction D moves the first check valve 220 to the open position and allows liquid from the inlet 204 to move through the check valve inlet 230 and the outlet 232 of the first check valve 220, through the second check valve 222, and into chamber 218 of the pump 208. In certain embodiments, the first check valve 220 is a high flow valve that is configured to prevent static drip of liquid from the inlet 204 into the pump 208 when the first check valve 220 is in the closed position.

The second check valve 222 is disposed between the first check valve 220 and the pump 208. In certain embodiments, the second check valve 222 is disposed adjacent to the pump chamber 218 of the pump 208. The second check valve 222 is configured to prevent air from being compressed between the pump 208 and the first check valve 220 during priming and use of the dispenser 200. Dispensers not having the second check valve 222 may have air being compressed/uncompressed in a space between (e.g., space 240 of the first check valve 220) that is between the inlet 230 and the pump 208. The second check valve 222 prevents air from being compressed/uncompressed in space 240. Movement of the second check valve 222 from the closed position to the open position allows liquid to flow from the container (not shown), through first check valve 220 and into the pump chamber 218, and movement of the second check valve 222 from the open position to the closed position prevents fluid from flowing past the second check valve 22 toward the container. It also limits the volume of the pump chamber 218 and prevents air from being compressed/uncompressed between the inlet 230 and the pump 208. In certain embodiments, the second check valve 222 is a high flow, fast acting valve. The second check valve 222 can be, for example, an umbrella valve, a duckbill valve, a flapper valve, or the like. In certain embodiments, the second check valve 222 is a normally-open valve. In alternative embodiments, the second check valve 222 is a normally-closed valve. In certain embodiments, the second check valve 222 has a minimal cracking pressure, such that pressure from the movement of the liquid causes the second check valve to move to an open position.

In certain embodiments, the first check valve 220 has a greater cracking pressure than the second check valve 222. In various embodiments, the first check valve 220 can have a cracking pressure between about 0.5 psi and about 3 psi. The second check valve 222 can have a cracking pressure between about 0 psi and about 2 psi.

To operate the dispenser 200, a user activates the pump 208, which causes the pump chamber 218 to move from an expanded position to a compressed position. This movement from the expanded position to the compressed position forces liquid in the pump chamber 218 to move through the pump outlet and into a hand of the user. During this movement of the pump chamber 118 from the expanded to the compressed position, the second check valve 222 maintains a closed position. After the liquid is moved through the pump outlet 216, the pump chamber 218 moves back to the expanded position, which creates a vacuum pressure in the pump chamber 218. This vacuum pressure creates a suction that causes the ball 226 of the first check valve 220 to move in the direction D, which causes the first check valve 220 to be in an open position, and allows liquid to flow past the second check valve 222 and enter the pump chamber 218 to prime the pump 208. The second check valve 222 is advantageous because air entering the pump chamber 218 during priming of the pump 208 may prevent the pump chamber 218 from being sufficiently filled with liquid from the inlet 204, which would cause the pump 208 to be less efficient or not work at all.

The first check valve 220 remains in the open position until there is no longer a vacuum pressure in the pump chamber 218 that exceeds the cracking pressure of the first check valve 220. Once the pump chamber 218 no longer has a vacuum pressure that is higher than the cracking pressure, the biasing member 228 forces the ball 226 to move in the direction Z such that the first check valve 220 is in a closed position. When the first check valve 220 is in the closed position, the liquid from the inlet 204 is prevented from entering the chamber 218 of the pump 208. The pump 208 is in a primed position when the pump chamber 218 is filled with liquid, and the first check valve 220 is in the closed position. After the pump 208 is in the primed position, the dispenser 200 is ready for use by a user, and the cycle for operating the dispenser 200 described above is used to dispense liquid from the dispenser.

The exemplary embodiments of the pumps, first check valves, and second check valves described herein can be part of a replaceable refill unit for a dispenser, or can be fixed to the housing of a dispenser. In addition, the exemplary first and second check valves described herein can be disposed within the housing of the pump, or can be separate from the pump.

Figure 3:
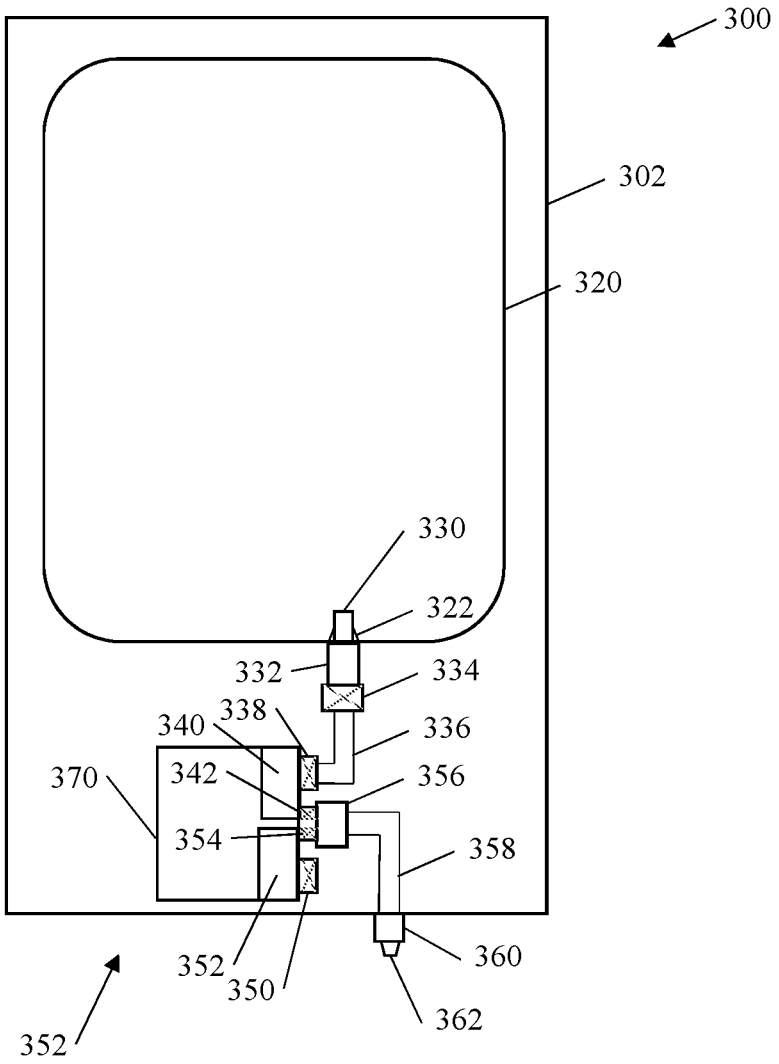
FIG. 3 is a simplified schematic view of an exemplary embodiment of a dispenser.

FIGS. 3-8 are additional embodiments of dispenser systems having two inlet valves and the inlet valves may have any of the characteristics identified above. The inlet valves may be referred to herein as one-way valves, or one way-check valves. FIG. 3 is a simplified schematic view of an exemplary embodiment of a dispenser 300. Dispenser 300 includes a housing 302. In this exemplary embodiment, housing 302 surrounds container 320 when the dispenser 300 is in use. In some embodiments, housing 302 only partially surrounds container 302. Container 302 is removable from dispenser 302. Container 302 includes a sealing member 322. In some embodiments, sealing member 322 is a seal that is broken by liquid inlet conduit 330 when container 302 is inserted into dispenser 300. In some embodiments, sealing member 322 "reseals" container 302 when container 302 is removed from dispenser 300. Thus, when container 302 is removed from dispenser 300, fluid inside of container 302 is prevented from draining out of container 302. In some embodiments, sealing member 322 is a valve, such as a slit valve, a displacement valve, a flap valve, or the like.

Dispenser system 300 includes a first check valve 334. First check valve 324 is in fluid communication with liquid inlet conduit 330. First check valve 324 is a one-way valve. In some embodiments, first check valve 324 is a ball and spring valve. First check valve 324 has a cracking pressure that is sufficient to hold back head pressure in container 330 when container 330 is connected to dispenser 300. In some embodiments, first check valve 334 has a cracking pressure of greater than or equal to 0.5 pounds per square inch ("psi"). In some embodiments, first check valve 334 has a cracking pressure of greater than or equal to 1.0 psi. In some embodiments, first check valve 334 has a cracking pressure of between about 0.5 psi and about 4 psi. In some embodiments, first check valve 334 has a cracking pressure of between about 0.5 psi and about 3 psi. In some embodiments, first check valve 334 has a cracking pressure of between about 0.75 psi and about 2 psi. In some embodiments, first check valve 334 has a cracking pressure of between about 0.75 psi and about 1.25 psi. In some embodiments, first check valve 334 has a cracking pressure of about 1 psi.

Liquid conduit 336 places first check valve 334 in fluid communication with second check valve 338 and liquid pump chamber 340. Preferably, second check valve 338 has a cracking pressure of less than first check valve 334. In some embodiments, the cracking pressure of second check valve 338 is less than 2 psi. In some embodiments, the cracking pressure of second check valve 338 is less than 2 psi. In some embodiments, the cracking pressure of second check valve 338 is less than 1.5 psi. In some embodiments, the cracking pressure of second check valve 338 is less than 1 psi. In some embodiments, the cracking pressure of second check valve 338 is less than 0.5 psi. In some embodiments, the cracking pressure of second check valve 338 is about 0.0 psi. In some embodiments, the cracking pressure of second check valve 338 is between 0 and 2 psi. In some embodiments, the cracking pressure of second check valve 338 is between 0 and 1 psi. In some embodiments, the cracking pressure of second check valve 338 is between 0 and 0.5 psi.

In some embodiments, second check valve 338 is a fast acting valve and its actuation rate is faster than first check valve 334. In some embodiments, second check valve 338 actuates two or more times for each actuation of first check valve 334. In some embodiments, second check valve 338 actuates five or more times for each actuation of first check valve 334. In some embodiments, second check valve 338 actuates ten or more times for each actuation of first check valve 334. In some embodiments, second check valve 338 actuates twenty or more times for each actuation of first check valve 334.

Liquid pump chamber 340 is in pump 341. Pump 341 is operated by motor 370. Downstream of pump chamber 340 is a pump outlet valve 342, a mixing chamber 356, and outlet conduit 358, a foaming cartridge 360, which may container one or more foaming members (not shown), such as, for examples, one or more screens, baffles, sponges, and combinations thereof, and an outlet nozzle 362. Pump 370 also includes an air pump chamber 352, an air inlet valve 350, and an air outlet valve 354.

During operation, motor 370 is actuated when a dispense of fluid is desired. Actuation of motor 370 compresses and expands liquid pump chamber 340 and air pump chamber 352. When air pump chamber 352 expands, one way air-inlet valve 350 opens allowing air to flow into the air pump chamber 352. As air pump chamber 352 contracts, one-way check valve 350 shuts and one-way air outlet valve 354 opens allowing air to flow into the mixing chamber 356. Expansion of liquid pump chamber 342 draws liquid in through conduit 330, through first check valve 334, through conduit 336, through second check valve 338 and into pump chamber 340. Compression of liquid pump chamber 340 causes second check valve 338 to close. First check valve 334 is biased closed and closes when liquid stops flowing through liquid inlet conduit 330, however, first check valve 334 may not close each time that second check valve 338 closes. In some embodiments, pump chamber 340 expands and contracts fast enough that liquid continues to flow through liquid inlet conduit 330, without first check valve 334 closing each time liquid pump chamber 342 contracts and expands. In some embodiments, first check valve 338 remains open substantially the same amount of time as motor 370 operates to dispense fluid and second check valve 338 opens and shuts many times during the same time period. As liquid pump chamber 342 compresses, liquid outlet valve 342 opens and liquid flows into mixing chamber 356, where the liquid and air mix and flow out of outlet conduit 358, through foam generator 360 and out of outlet 262 in the form of a foam.

Figure 4:
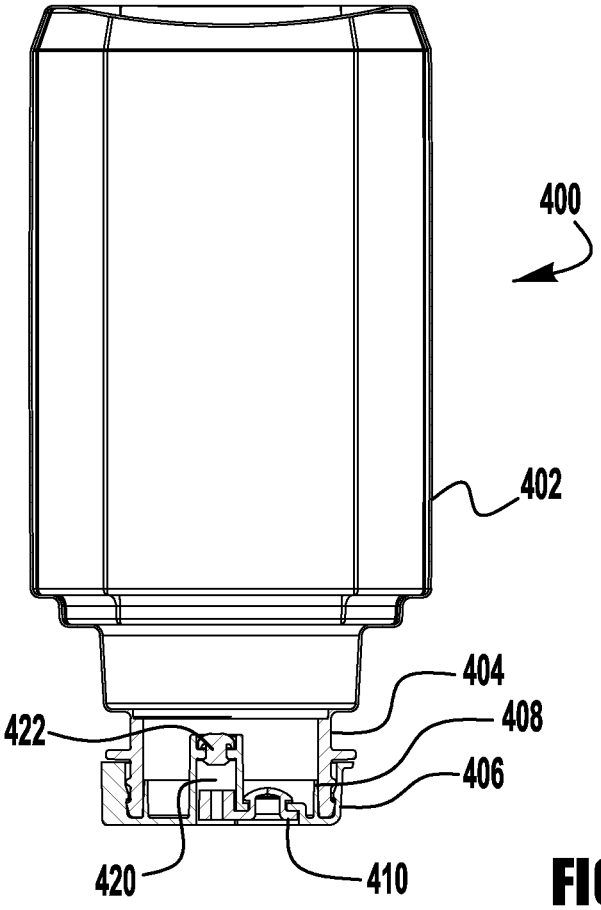
FIG. 4 is a cross-sectional view of an exemplary embodiment of a refill unit for the exemplary embodiment of a dispenser having double inlet valves.

FIG. 4 is a cross-sectional view of an exemplary embodiment of a refill unit 400 for a dispenser 500. Refill unit 400 includes a contain 402 having a neck 404. A closure 406 is connected to neck 404. Located in closure 406 is an optional annular channel 420 and a container vent valve 422 secured thereto. As liquid is pumped out of container 402, vacuum pressure draws air in through air vent valve 422. In some embodiments, the container 402 is collapsible and therefore may not require an air vent valve 422. Air vent valve 422 is a one-way air inlet valve and accordingly, prevents liquid from flowing out of the container 402. In addition, closure 406 includes an optional annular channel 408. A sealing member 410 is located in annular channel 408. Annular channel 408 and annular channel 420 are optional and other means or areas may be used to secure the optional vent valve 422 and sealing member 410. In some embodiments, sealing member 410 is a pierceable member that is pierced by a liquid inlet conduit. Preferably, sealing member 410 is a valve that opens when contacted with a liquid inlet conduit, and closes when separated from the liquid inlet conduit. This allows the refill unit 400 to be able to be removed without leaking. Exemplary sealing members that open when contacted with liquid inlet conduit 406 and close when separated from the liquid inlet conduit 406 include, for example, a slit valve, a displacement valve, a flapper valve, and the like.

Figure 5:
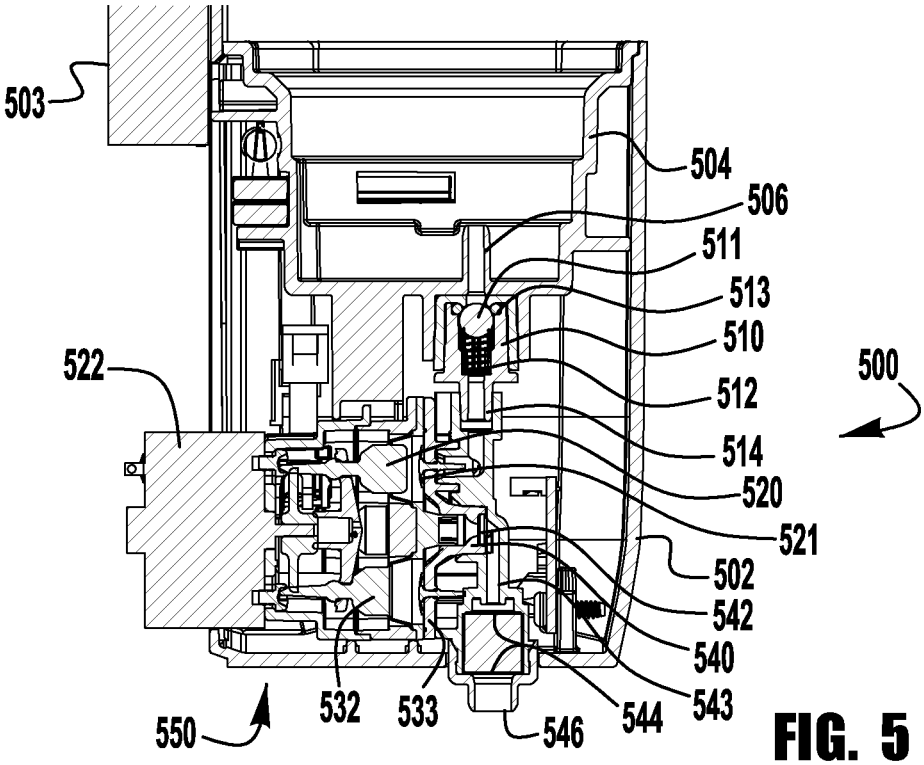
FIG. 5 is cross sectional view of an exemplary embodiment of a portion of a dispenser having double inlet valves for receiving the refill unit of FIG. 4.

FIG. 5 is cross-sectional view of an exemplary embodiment of a portion of a dispenser 500 having double inlet valves for receiving refill unit 400. Dispenser 500 includes housing 502 and a back plate 503. Located within housing 502 is a receptacle 504 for receiving refill unit 400. Extending up from the floor of receptacle 504 is liquid inlet conduit 506. First check valve 510 is in fluid communication with liquid inlet conduit 506 when the refill unit 400 is inserted in dispenser 500. In this exemplary embodiment, first check valve 510 is a ball and spring valve and includes a ball 511 and spring 512. In addition, in this exemplary embodiment, first check valve 510 includes an o-ring seat for ball 511 to seal against.

Dispenser 500 includes a pump 550. Pump 550 is operated by motor 522. Pump 550 includes a liquid pump chamber 521 and an air pump chamber 532. In addition, pump 550 incudes a second check valve 521 (the liquid chamber inlet valve), an air inlet check valve 533, and a fluid outlet valve 540. In this exemplary embodiment, fluid outlet valve 540 is the outlet valve for both the liquid pump chamber 520 and the air pump chamber 540. In some embodiments, separate outlet valves may be used.

First check valve 510 is in fluid communication with liquid pump chamber 520 and second check valve 521. First and second check valves 510, 521 may have any of the features/parameters/settings described herein with respect to the valves herein, including the first and second check valves and/or first and second inlet valves. Dispenser 500 further includes a mixing chamber 542, outlet conduit 543, a pair of foaming members 544, such as, for example, a pair of screens. Dispenser 546 also includes an outlet 546.

Figure 6:
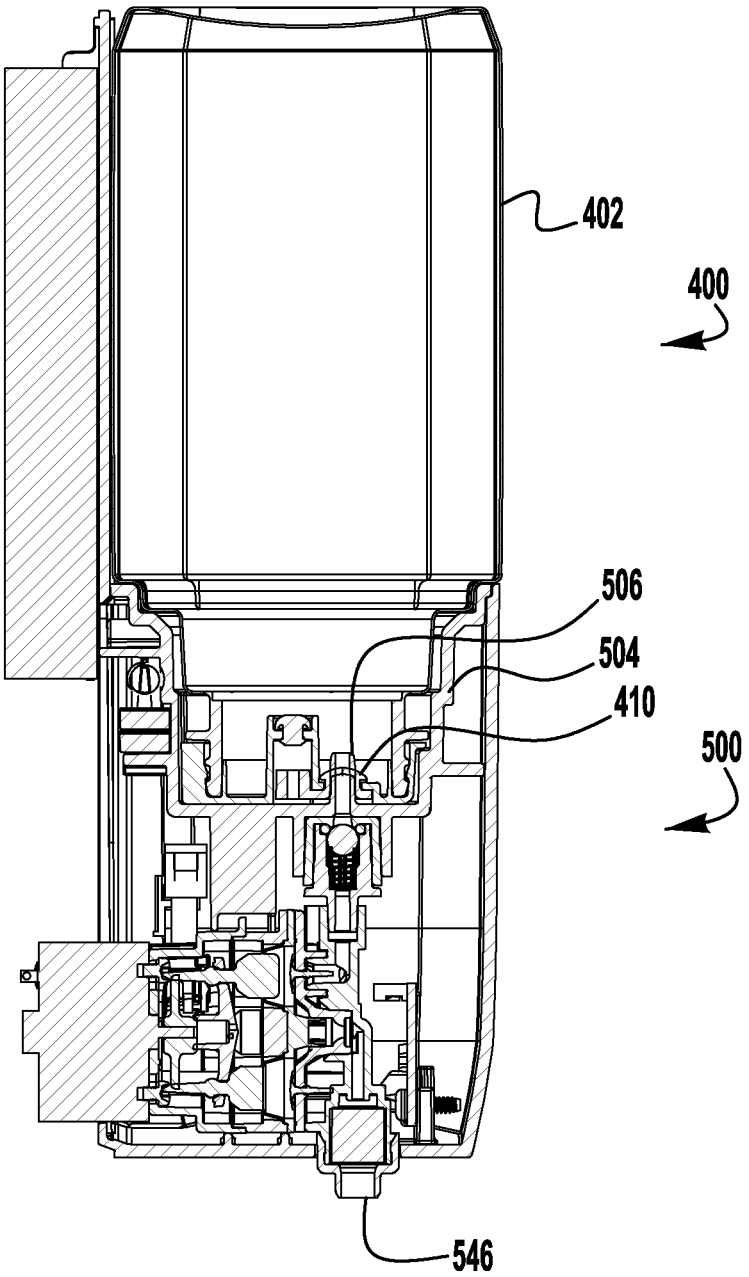
FIG. 6 is a cross-sectional view of the refill unit of FIG. 4 in the dispenser of FIG. 5.

FIG. 6 is a cross-sectional view of the refill unit 400 in the dispenser 500. Receptacle 504 receives the neck and closure of refill unit 400. Liquid inlet conduit 506 extends through sealing member 410 placing the liquid inlet conduit 506 in fluid communications with the interior of container 402. When refill unit 400 is removed from dispenser, sealing member 410 reseals itself preventing any fluid located within container 402 from flowing out of the container 402. Dispenser 500 operates similar to the other embodiments described herein.

Figures 7, 8:
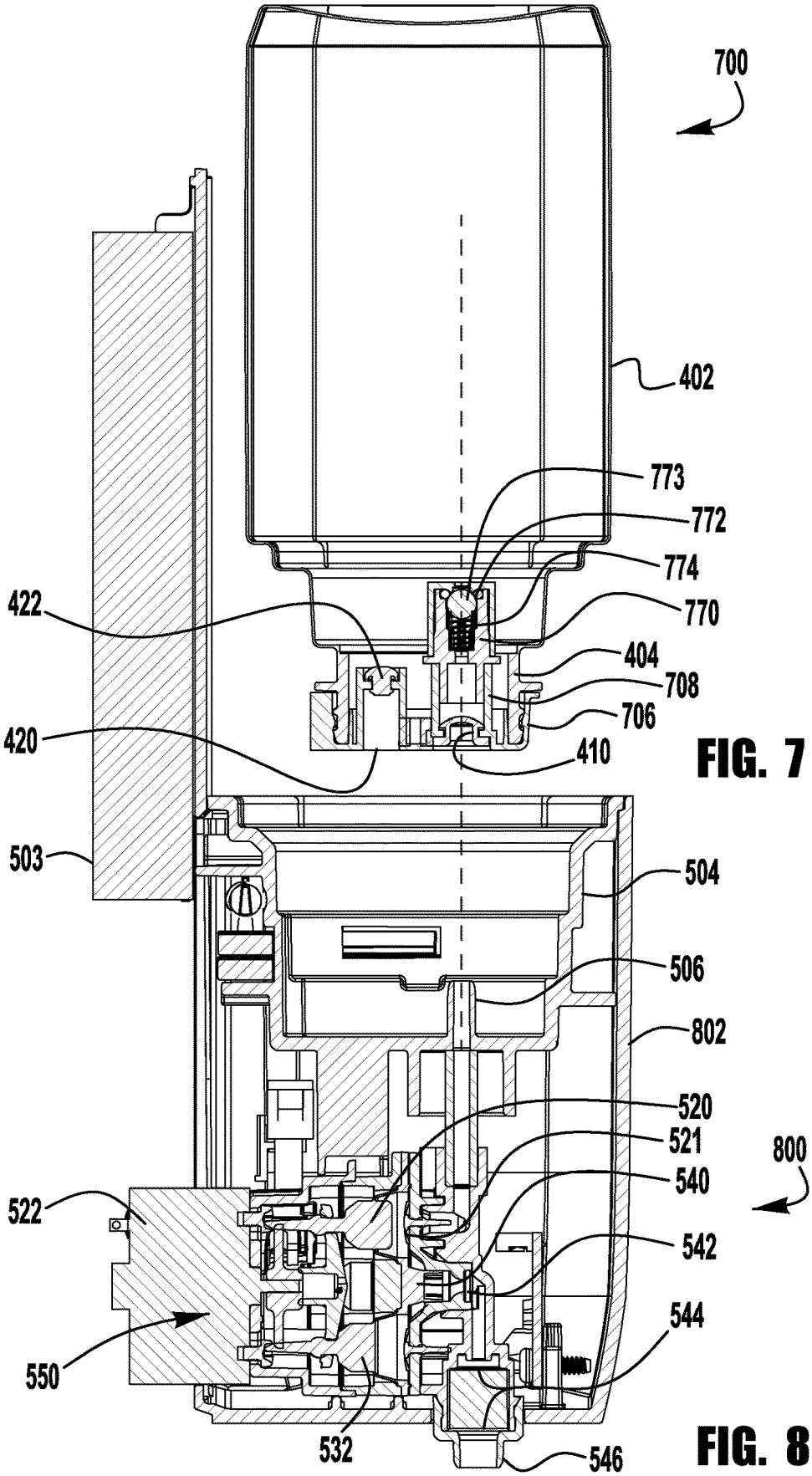
FIG. 7 is a cross-sectional view of an exemplary embodiment of a refill unit for the exemplary embodiment of a dispenser of FIG. 8.
FIG. 8 is cross sectional view of an exemplary embodiment of a dispenser having for receiving the refill unit of FIG. 7.

FIG. 7 is a cross-sectional view of an exemplary embodiment of a refill unit 700 for dispenser 800. In this exemplary embodiment, many of the components are the same as those described with respect to refill unit 400 and components having the same numeric identifiers are not re-described herein. Closure 706 is connected to the neck 404 of the container. Closure 706 includes an optional vent valve 422. Closure 706 includes an annular projection 708. Sealing member 410 is located in annular projection 708. In addition, first check valve 770 is secured to annular projection 708. In this exemplary embodiment, first check valve 770 is a ball and spring valve. First check valve 770 includes a ball 772 and a spring 774, and in addition, first check valve 770 includes an o-ring 773 that serves as a seat for ball 772.

FIG. 8 is cross sectional view of an exemplary embodiment of a dispenser 800. Dispenser 800 includes a housing 802. This exemplary embodiment is similar to dispenser 500 described herein and similar components have been identified with the same numeric identifier. Unlike housing 502, hosing 802 does not contain a first check valve as the first check valve is in refill unit 500. Refill unit 700 may be inserted and removed from dispenser 800. Dispenser 800 operates similar to the dispenser described herein.

While various inventive aspects, concepts and features of the inventions may be described and illustrated herein as embodied in combination with exemplary embodiments, these various aspects, concepts and features may be used in many alternative embodiments, either individually or in various combinations and sub-combinations thereof. Unless expressly excluded herein, all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

The invention claimed is:

1. A dispensing system comprising:

a housing;

a removable and replaceable container for holding a liquid;

the removable and replaceable container having a neck;

a closure connected to the neck;

wherein the container is configured to be used in an inverted position with the neck at the bottom of the container when the container is installed in a dispenser;

the closure having a resealable sealing member;

wherein the resealable sealing member remains in the closure when the dispenser system is in use;

a receptacle for receiving the container;

a hollow projecting member located in the receptacle;

wherein the hollow projecting member opens the resealable sealing member when the container is placed in the receptacle and wherein the resealable sealing member reseals itself upon removal of the container from the receptacle;

a pump;

a fluid flow path between the hollow projection member and the pump;

a normally closed spring biased check valve located in the fluid flow path;

the normally closed spring biased check valve having a cracking pressure that is higher than the static pressure created by the fluid in a full container;

a second normally closed check valve located between the liquid pump chamber and the normally closed spring-biased check valve;

a liquid outlet valve downstream of the liquid pump chamber; and an outlet nozzle.

2. The dispenser of claim 1, the normally closed spring biased check valve has a first actuation rate and the second normally closed check valve as a second actuation rate, and wherein the second actuation rate is faster than the first actuation rate.

3. The dispenser of claim 1, wherein the normally closed spring biased check valve further comprises an o-ring.

4. The dispenser of claim 1, wherein the normally closed spring biased check valve remains connected to the dispenser housing when the container is removed from the dispenser.

5. The dispenser of claim 1, wherein the normally closed spring biased check valve is connected to the container and is removed from the dispenser housing when the container is removed from the dispenser.

6. The dispenser of claim 1, further comprising one or more air pump chambers.

7. The dispenser of claim 5 comprising two or more air pump chambers and wherein the liquid pump chamber and the two or more air pump chambers form a pump that is a sequentially activated diaphragm pump, wherein a first diaphragm of the sequentially activated diaphragm pump comprises the liquid pump chamber and two or more diaphragms comprise the two or more air pump chambers.

8. The dispenser of claim 1, wherein the cracking pressure of the second normally closed check valve is lower than the static pressure created by a full container of liquid.

9. The dispenser of claim 1, wherein the second normally closed valve is configured to actuate two or more times for each actuation of the normally closed spring biased check valve.

10. The dispenser of claim 1, wherein the normally closed spring biased check valve is a spring and ball check valve.

11. A dispensing system comprising:

a housing;

a removable and replaceable container for holding a liquid;

the removable and replaceable container having a neck;

a closure connected to the neck;

wherein the container is configured to be used in an inverted position with the neck at the bottom of the container when the container is installed in a dispenser;

the closure having a resealable sealing member;

wherein the resealable sealing member remains in the closure when the dispenser system is in use;

a receptacle for receiving the container;

a hollow projecting member located in the receptacle;

wherein the hollow projecting member opens the resealable sealing member when the container is placed in the receptacle and wherein the resealable sealing member reseals itself upon removal of the container from the receptacle;

a pump;

a fluid flow path between the hollow projection member and the pump;

a first normally closed check valve located in the fluid flow path;

a second normally closed check valve located between the liquid pump chamber and the first normally closed check valve;

wherein the second normally closed valve is configured to actuate two or more times for each actuation of the first normally closed check valve;

a liquid outlet valve downstream of the liquid pump chamber; and an outlet nozzle.

12. The dispenser of claim 11, the first normally closed check valve has a first actuation rate and the second check valve as a second actuation rate, and wherein the second actuation rate is faster than the first actuation rate.

13. The dispenser of claim 11, wherein the first normally closed check valve remains connected to the dispenser housing when the container is removed from the dispenser.

14. The dispenser of claim 11, wherein the first normally closed check valve is connected to the container and is removed from the dispenser housing when the container is removed from the dispenser.

15. The dispenser of claim 11 further comprising two or more air pump chambers and wherein the liquid pump chamber and the two or more air pump chambers form a pump that is a sequentially activated diaphragm pump, wherein a first diaphragm of the sequentially activated diaphragm pump comprises the liquid pump chamber and two or more diaphragms comprise the two or more air pump chambers.

16. The dispenser of claim 11, wherein the cracking pressure of the second normally closed check valve is lower than the static pressure created by a full container of liquid.

17. The dispenser of claim 11, wherein the cracking pressure of the first normally closed check valve is higher than the static pressure created by a full container of liquid.

18. A dispensing system comprising:

a housing;

a removable and replaceable container for holding a liquid;

the removable and replaceable container having a neck;

a closure connected to the neck;

wherein the container is configured to be used in an inverted position with the neck at the bottom of the container when the container is installed in a dispenser;

the closure having a vent valve; and a resealable sealing member;

wherein the resealable sealing member remains in the closure when the dispenser system is in use;

a receptacle for receiving the container;

a liquid inlet member located in the receptacle;

wherein the liquid inlet opens the resealable sealing member when the container is placed in the receptacle and wherein the resealable sealing member reseals itself upon removal of the container from the receptacle;

a pump;

a fluid flow path between the liquid inlet and the pump;

a first normally closed check valve located in the fluid flow path;

wherein the cracking pressure of the first normally closed check valve is higher than a static pressure created by a full container of liquid;

a second normally closed check valve located between the liquid pump chamber and the first normally closed check valve;

wherein the cracking pressure of the second normally closed check valve is lower than the static pressure created by a full container of liquid;

a liquid outlet valve downstream of the liquid pump chamber; and an outlet nozzle.

19. The dispenser of claim 18, the first normally closed check valve has a first actuation rate and the second check valve as a second actuation rate, and wherein the second actuation rate is faster than the first actuation rate.

20. The dispenser of claim 18, wherein the first normally closed check valve remains connected to the dispenser housing when the container is removed from the dispenser.

* * * * *